US007343723B2

(12) United States Patent
Perkins

(10) Patent No.: US 7,343,723 B2
(45) **Date of Patent: *Mar. 18, 2008**

(54) METHOD AND APPARATUS FOR PRE-TEARING STRINGS OF AIR-FILLED PACKING MATERIALS AND THE LIKE

(75) Inventor: Andrew Perkins, Berkeley, CA (US)

(73) Assignee: Free-Flow Packaging International, Inc., Redwood City, CA (US)

( * ) Notice: Subject to any disclaimer, the term of this patent is extended or adjusted under 35 U.S.C. 154(b) by 600 days.

This patent is subject to a terminal disclaimer.

(21) Appl. No.: 10/766,754

(22) Filed: Jan. 27, 2004

(65) Prior Publication Data

US 2005/0160699 A1 Jul. 28, 2005

(51) Int. Cl.
*B65B 31/00* (2006.01)

(52) U.S. Cl. ..... 53/403; 53/79; 53/284.7; 53/512; 53/558

(58) Field of Classification Search ..... 53/403, 53/79, 512, 558, 562, 567; 225/2, 4, 96, 225/96.5, 100, 106
See application file for complete search history.

(56) References Cited

U.S. PATENT DOCUMENTS

| | | | | |
|---|---|---|---|---|
| 3,727,814 | A * | 4/1973 | Kuckhermann | 225/100 |
| 3,902,677 | A | 9/1975 | Wolf | |
| 4,017,351 | A | 4/1977 | Larson et al. | |
| 4,096,306 | A | 6/1978 | Larson | |
| 4,169,002 | A | 9/1979 | Larson | |
| RE30,398 | E * | 9/1980 | Schueler | 225/100 |
| 4,222,511 | A | 9/1980 | Schueler | |
| 4,261,497 | A * | 4/1981 | Roetter et al. | 225/100 |
| 4,493,684 | A * | 1/1985 | Bolton | 493/234 |
| 4,577,789 | A * | 3/1986 | Hofmann et al. | 225/100 |
| 4,936,079 | A | 6/1990 | Skalsky et al. | |
| 4,997,119 | A * | 3/1991 | Meschi | 225/100 |
| 5,230,453 | A * | 7/1993 | Meschi | 225/100 |
| 5,480,083 | A * | 1/1996 | Achelpohl | 225/100 |
| 5,529,564 | A * | 6/1996 | Hediger | 493/413 |
| 5,581,983 | A | 12/1996 | Murakimi | |
| 5,660,662 | A | 8/1997 | Testone | |
| 5,824,392 | A | 10/1998 | Gotoh et al. | |
| 5,873,215 | A | 2/1999 | Aquarius et al. | |
| 5,937,614 | A | 8/1999 | Watkins et al. | |
| 6,209,286 | B1 | 4/2001 | Perkins et al. | |
| 6,410,119 | B1 | 6/2002 | DeLuca et al. | |
| 6,423,166 | B1 | 7/2002 | Simhaee | |
| 6,582,800 | B2 * | 6/2003 | Fuss et al. | 428/178 |
| 2001/0013215 | A1 | 8/2001 | Fuss et al. | |
| 2003/0163976 | A1 * | 9/2003 | Perkins et al. | 54/403 |
| 2005/0139627 | A1 * | 6/2005 | Chen et al. | 225/100 |

* cited by examiner

*Primary Examiner*—Thanh K. Truong
(74) *Attorney, Agent, or Firm*—Edward S. Wright

(57) ABSTRACT

Method and apparatus which facilitate the tearing of packing materials and the like into desired lengths by pre-tearing them along the rows of perforations which are provided for that purpose. In the disclosed embodiments, a packing material having inflated chambers separated by rows of perforations is fed at a predetermined speed in a direction generally perpendicular to the rows and periodically pulled upon rather abruptly to produce a partial tearing of the material along the rows of perforations.

19 Claims, 4 Drawing Sheets

FIG. 1
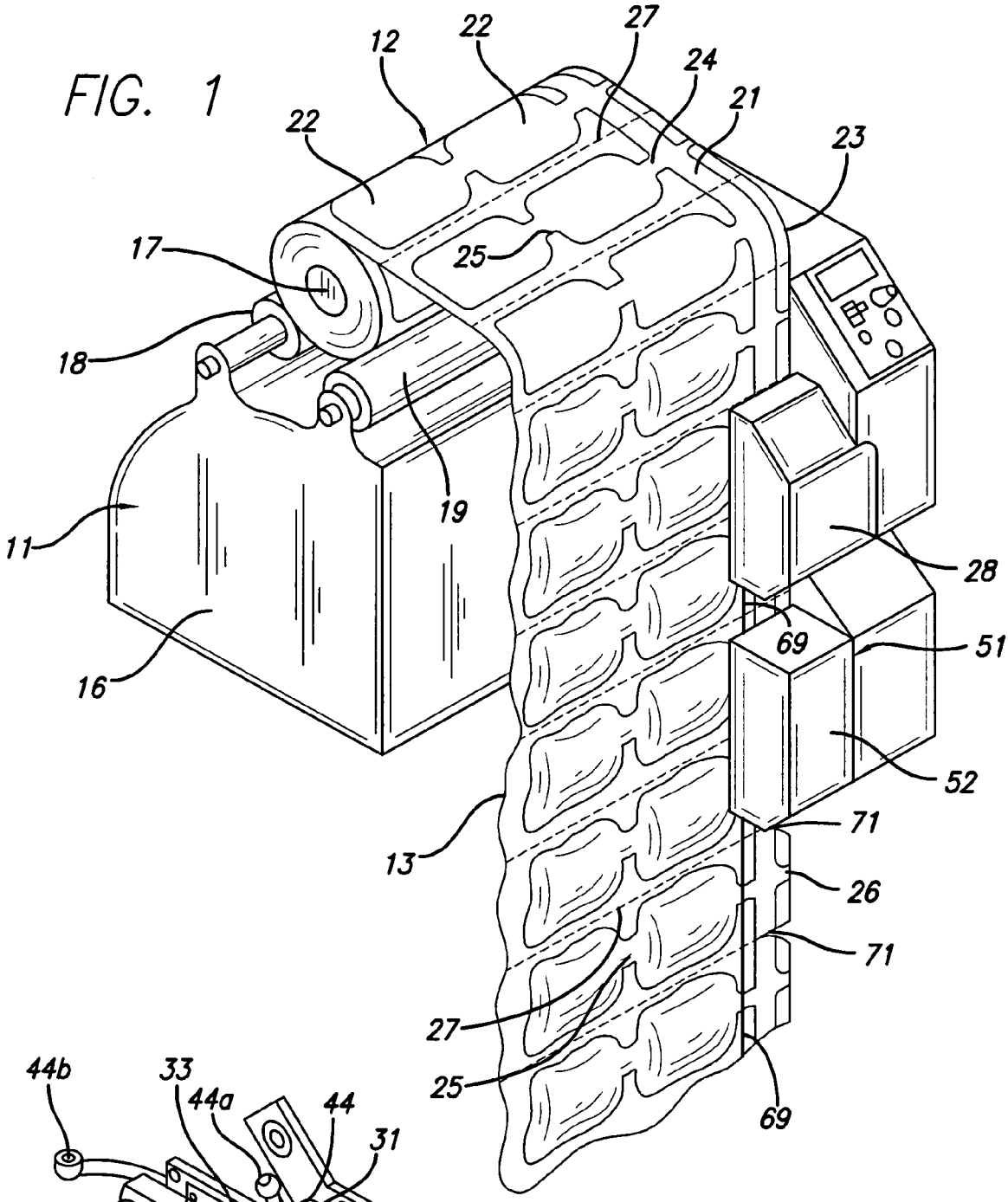
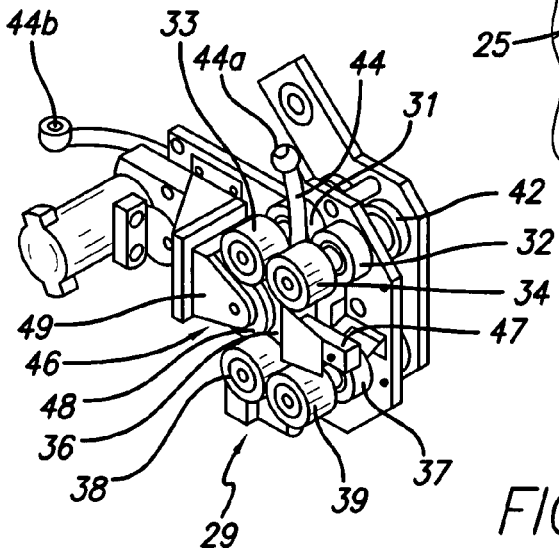
FIG. 2

METHOD AND APPARATUS FOR PRE-TEARING STRINGS OF AIR-FILLED PACKING MATERIALS AND THE LIKE

BACKGROUND OF THE INVENTION

1. Field of Invention

This invention pertains generally to air-filled packing materials and the like and, more particularly, to a method apparatus for pre-tearing strings of such materials so they can be more readily separated into desired lengths for use.

2. Related Art

In recent years, air-filled packing materials have come into wide use as a cushioning material or void filler in shipping cartons and the like.

One of the advantages of such materials is that they can be made from a preconfigured film material which is shipped and stored in a relatively compact form, typically on rolls or folded in boxes, and not inflated until it is at or near the point of use.

The inflated film material is usually discharged from the machine which inflates it in the form of a continuous string of cushions with lines of perforations between the cushions so that the material can be torn into desired lengths.

One problem with such materials is that, notwithstanding the perforations, it is sometimes difficult to tear the cushions apart as they are spewing out of the machine.

OBJECTS AND SUMMARY OF THE INVENTION

It is, in general, an object of the invention to provide a new and improved method and apparatus for making air-filled packing materials and the like.

Another object of the invention is to provide a method and apparatus of the above character which facilitate the tearing of perforated materials into desired lengths.

These and other objects are achieved in accordance with the invention by providing a method and apparatus which facilitate the tearing of packing materials and the like into desired lengths by pre-tearing them along the rows of perforations which are provided for that purpose. In the disclosed embodiments, a packing material having inflated chambers separated by rows of perforations is fed at a predetermined speed in a direction generally perpendicular to the rows and periodically pulled upon rather abruptly to produce a partial tearing of the material along the rows of perforations.

BRIEF DESCRIPTION OF THE DRAWINGS

FIG. 1 is an isometric view of one embodiment of a machine for inflating and pre-taring strings of air-filled packing cushions in accordance with the invention.

FIG. 2 is an isometric view of the inflation and sealing sections of the machine in the embodiment of FIG. 1.

DETAILED DESCRIPTION

Figure 3:
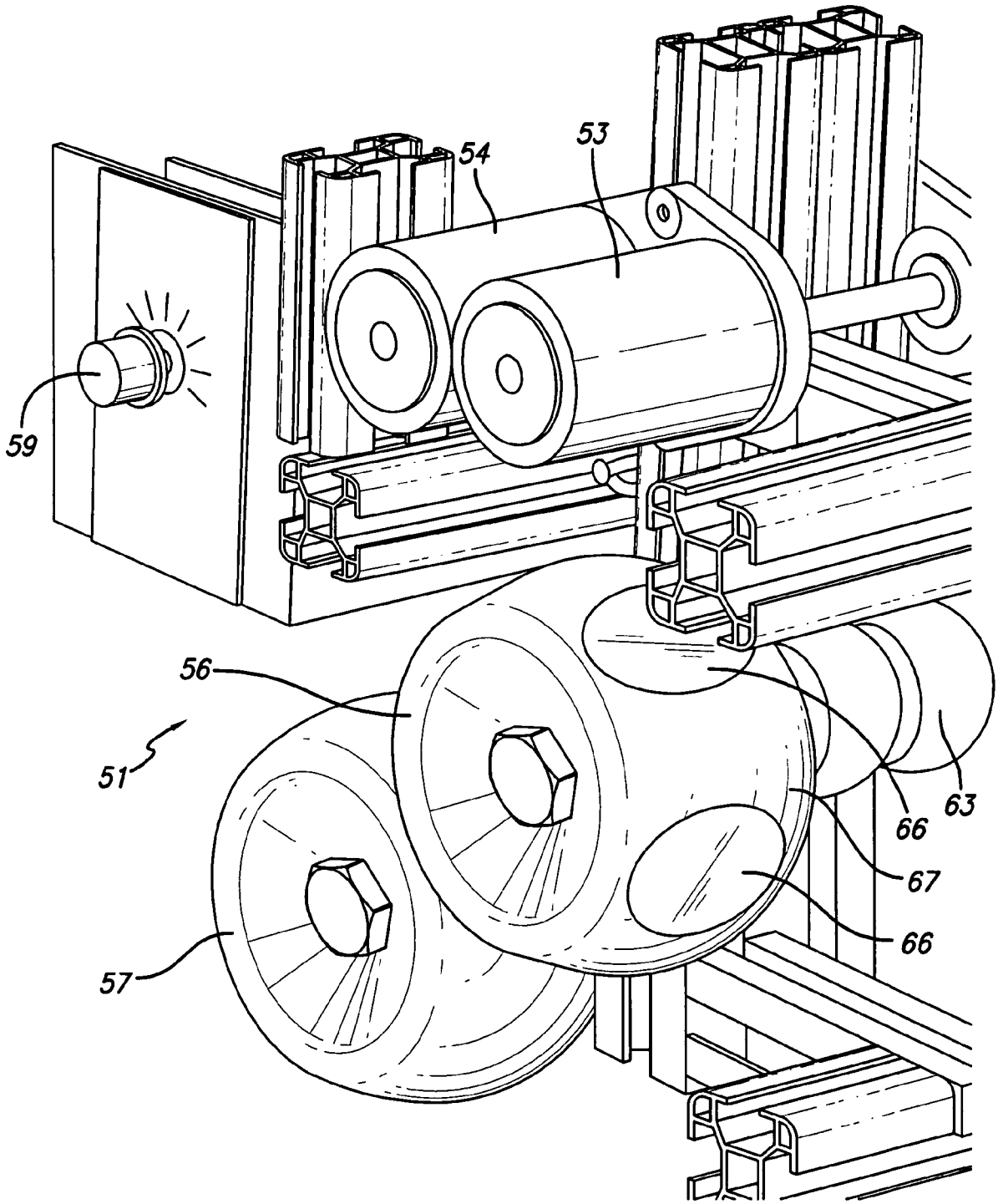
FIGS. 3 and 4 are an isometric views of the pre-tearing section of the machine in the embodiment of FIG. 1.
Figure 4:
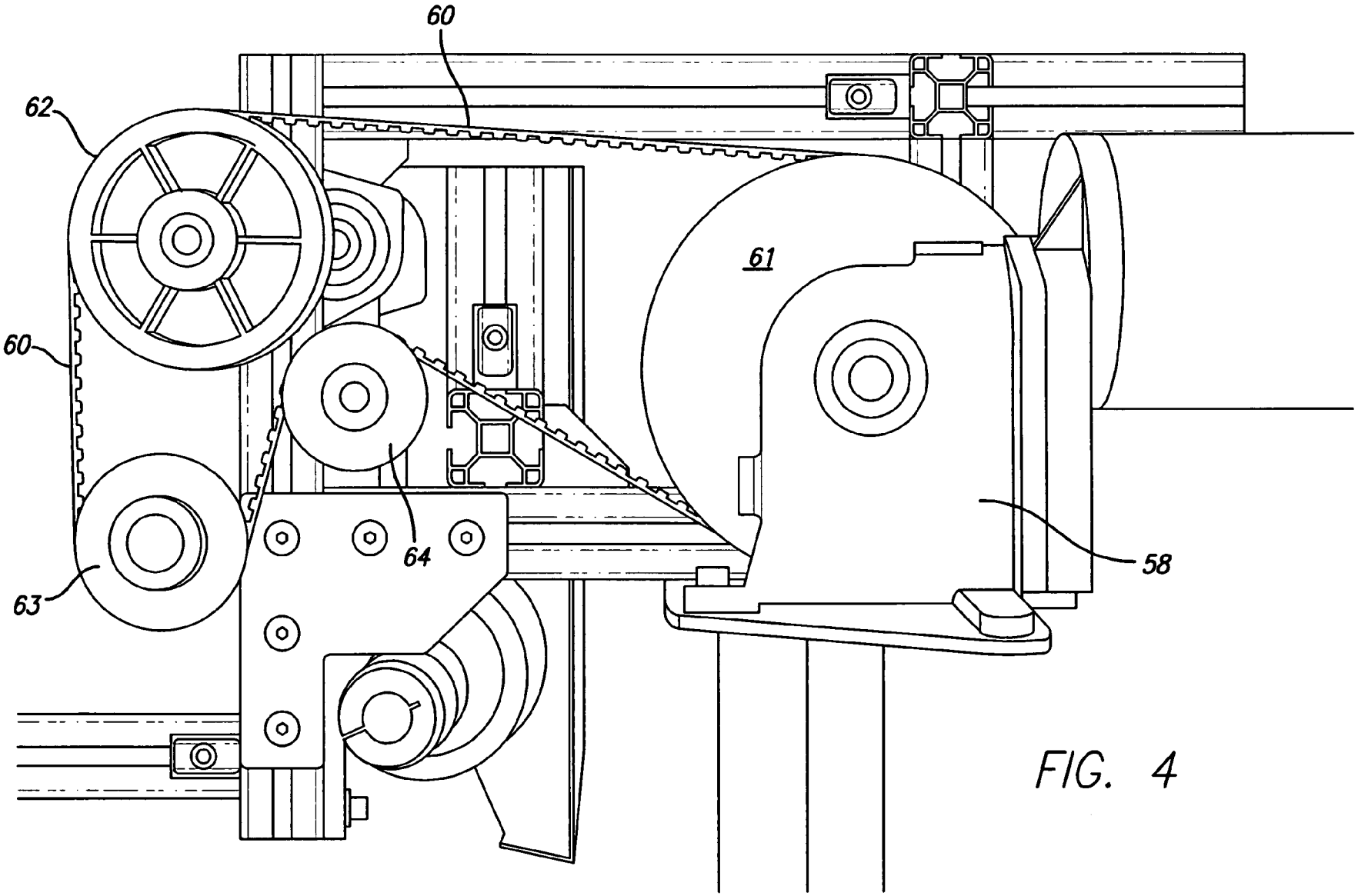

In the drawings, the invention is illustrated in conjunction with a machine 11 for inflating and sealing a preconfigured film material 12 to form strings of air-filled packing cushions 13. A particularly suitable machine of this type is described in detail in copending application Ser. No. 10/087,897, the disclosure of which is incorporated herein by reference.

The machine has a cabinet 16 which is adapted to rest on a table top or other supporting surface, and roll 17 of the preconfigured film material rests on a pair of horizontally extending support rollers 18, 19 on the top side of the cabinet.

The film material has two layers of a suitable plastic material such as polyethylene which are sealed together to form an inflation channel 21 and inflatable chambers 22. The inflation channel extends longitudinally near one edge 23 of the material, and the chambers are arranged in laterally or transversely extending rows. In the embodiment illustrated, there are two chambers in each row, but a greater or lesser number can be employed if desired.

Inlet passageways 24 extend interconnect the inflation channel and the first chamber in each row, and passageways 25 interconnect adjacent chambers within the rows. The material shown in this example also has outlet passageways 26 extend between the inflation channel and the edge 23 of the material. Other materials may not have the outlet openings.

Rows of perforations 27 extend laterally or transversely across the material between the rows of chambers so that the material can be torn into desired lengths.

The inflation and sealing sections of the machine are mounted on the front side of the cabinet and partially enclosed by a front cover 28, along with the drive mechanism which feeds the material through the machine.

As illustrated in FIG. 2, the drive mechanism 29 includes input rollers 31-34 and output rollers 36-39 which engage the edge portion of the film material and feed it through the machine. The input and output rollers are arranged in dual sets for engaging the film material on opposite sides of the inflation channel. Thus, input rollers 31, 32 and output rollers 36, 37 engage the film material between the inflation channel and the edge of the material, whereas input rollers 33, 34 and output rollers 38, 39 engage it between the channel and the chambers.

The feed rollers are driven by a motor (not shown) which is mounted inside the cabinet, with a drive gear on the motor shaft (not shown) driving gears 42 which are affixed to the shafts on which the rollers are mounted. The gearing is such that the output rollers rotate slightly faster than the input rollers (e.g., an 8:7 ratio) in order to tension the film material and maintain better control of it as it passes through the sealing assembly.

An inflation tube 44 is positioned between the inner and outer feed rollers and extends in an upward direction, curving inwardly as it does, for insertion into the inflation channel of the film material. Air is supplied to the tube at a pressure on the order of 0.5 to 10 psig by an air pump (not shown) mounted inside the cabinet. If desired, a regulator can be connected between the pump and the air tube to allow users to adjust the air pressure and, hence, the degree of firmness to which the cushions are inflated.

An enlarged bulb 44*a* at the upper or outlet end of the air tube facilitates movement of the film material over the end portion of the tube and also helps to prevent air from escaping back along the tube from the inflation channel. A fitting 44*b* at the inlet end of the tube connects the tube to the air pump.

A sealing assembly 46 is positioned between the input and output rollers and includes a heating element 47 and a roller 48 which presses the film material against the heating element. The heating element is mounted in a stationary position, and the roller is mounted on a carriage 49. The roller is pressed against the heating element by a cam when the machine is operating, and withdrawn from the heating element by springs when the machine is idle.

A knife blade (not shown) is mounted on or near the inflation tube for slitting the material open along the inflation channel so that it can travel away from the inflation tube.

The pre-tearing mechanism 51 is positioned beneath the inflation and sealing sections and is enclosed in a relatively small housing 52. It includes a pair of feed rollers 53, 54 which are disposed in the path of the material exiting from the sealing section and a pair of tear rollers 56, 57 which receive the material from the feed rollers.

One of the rollers in each pair is driven by a motor 58, the speed of which is controlled by a motor controller 59. The other roller in each pair presses the film material against the driven roller.

Feed roller 53 and tear roller 56 are driven by a cog belt 60 which is trained about a drive pulley 61 on the output shaft of the motor, pulleys 62, 63 connected to the rollers, and an idler wheel 64. The relative diameters of the rollers and the pulleys are such that the surfaces of the tear roller travel faster than the surfaces of the feed rollers. In the embodiment illustrated, the tear rollers are about twice the diameter of the feed rollers, feed roller pulley 62 is about 50 percent larger in diameter than tear roller pulley 63, and the surfaces of the tear rollers travel approximately three times as fast as the surfaces of the feed rollers.

In the embodiment illustrated, the tear rollers are crowned rollers, and tear roller 56 has an interrupted surface with flat sections 66 spaced in quadrature between arcuate sections 67. This roller is thus adapted to engage the film material and pull upon it on an intermittent or periodic basis. Because the tear rollers are travelling substantially faster than the feed rollers, the pull is a rather abrupt one which tears the material apart along the rows of perforations near the edge of the material. The extent of the tear is dependent to a large extent on the difference in speed between the two pairs of rollers, which is determined by the relative sizes of the rollers and pulleys and the speed of the motor.

Operation and use of the machine, and therein the method of the invention can now be described. The roll of preconfigured film material 12 is placed on support rollers 18, 19, and the free end of the material is threaded onto the upper end of inflation tube 44 and into engagement with upper feed rollers 31-34.

As the film material travels along the air tube, air injected through the tube flows from inflation channel 21 into chambers 22, thereby inflating the cushions.

Following inflation, the film material travels through sealing assembly 46 where roller 48 presses the material into direct contact with heating element 47. The two layers of film material are thus fused together along a relatively narrow seal line 69 which extends longitudinally of the film material and across inlet passageways 23 to seal the chambers.

As the string of inflated cushions leaves the sealing assembly, the edge portion of it is engaged by feed rollers 53, 54 which turn at approximately the same speed as output rollers 36-39. Since the inflated material is relatively stiff, it tends to feed along a fixed path toward feed rollers 53, 54 and is engaged automatically by those rollers both during initial feeding and in the event that the material should become dislodged from those rollers during operation of the machine. The ability of the rollers to re-engage the inflated film material from the side as it spews from the sealing section is quite spectacular.

The feed rollers are in continuous engagement with the inflated material and feed it toward tear rollers 56, 57 at a steady, fixed speed. The tear rollers are travelling at a substantially higher speed, but they engage the edge portion of the material only intermittently or periodically. When they do, they exert a rather abrupt tug or pull on the material which tends to tear it in the areas of weakness formed by the rows of perforations 27. The material tears from the edge 23 where the pull which is exerted, and the tear 71 extends only a short distance across the material. This pre-tearing occurs along each row of perforations, and makes it much easier to separate the cushions at a desired point.

Figure 5:
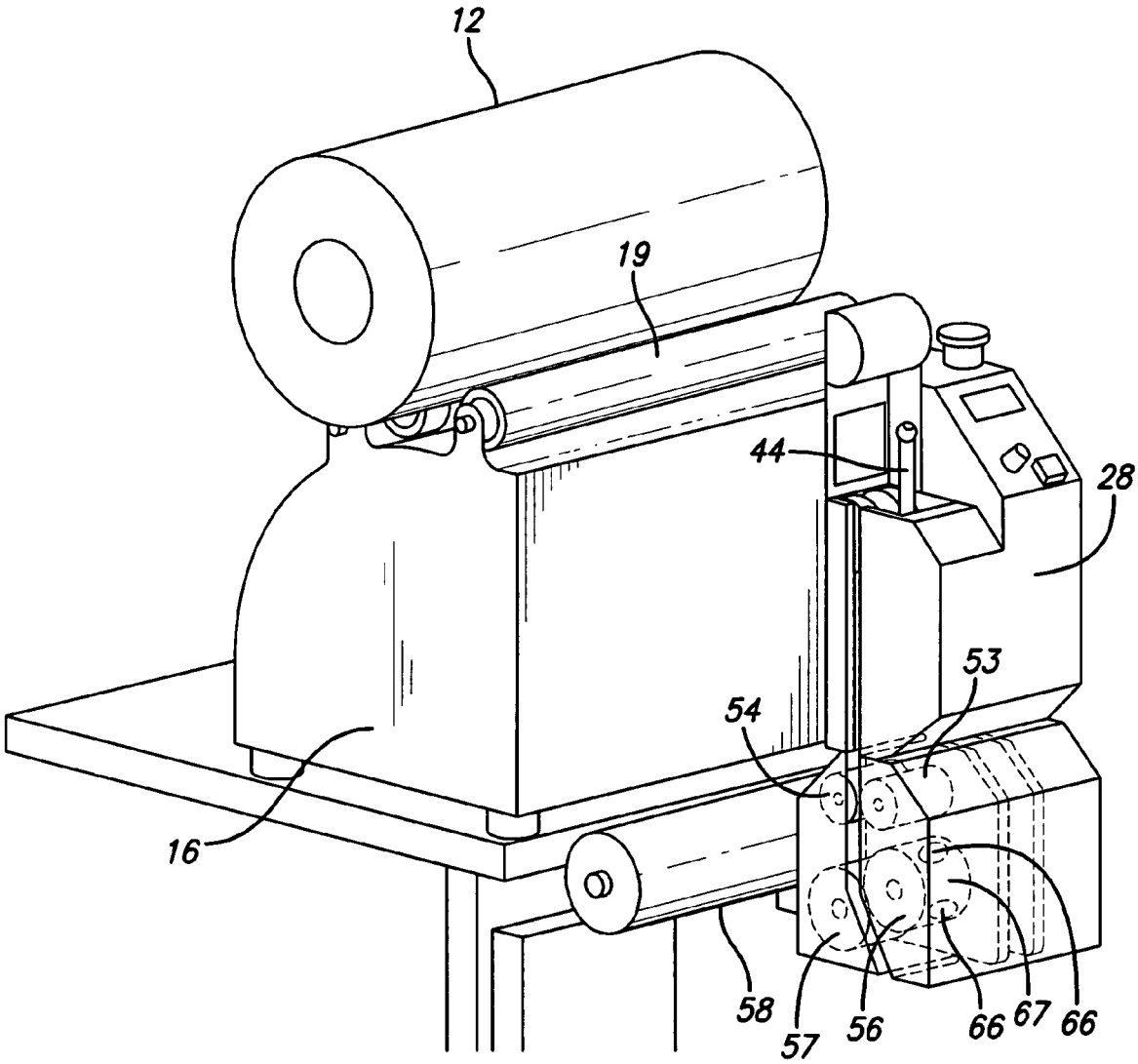
FIG. 5 is an isometric view, partly broken away of another embodiment of a machine for inflating and pre-taring strings of air-filled packing cushions in accordance with the invention.

The embodiment of FIG. 5 is similar to the embodiment of FIG. 1, and like reference numerals designate corresponding elements in the two embodiments. The embodiment of FIG. 5 differs, however, in that tear rollers 56, 57 are cylindrical rather than crowned and drive motor 58 is positioned to the front of cabinet 16 rather than to the side of it. Tear roller 56 has flat faces or facets 66 spaced about its periphery, with arcuate sections 67 between the flat surfaces for intermittent engagement with the film material. Alternatively, feed roller 53 and tear roller 56 can be driven by the same motor as the input and output rollers of drive mechanism 29, if desired.

Operation and use of the embodiment of FIG. 5 is identical to that of the embodiment of FIG. 1.

The invention has a number of important features and advantages. It makes it much easier to tear air-filled cushions and other perforated materials apart by pre-tearing them along lines of perforation, and it does so without the need for any timing mechanism to coordinate the tearing and the location of the perforations.

It is apparent from the foregoing that a new and improved method and apparatus for pre-tearing air-filled packing materials and the like have been provided. While only certain presently preferred embodiments have been described in detail, as will be apparent to those familiar with the art, certain changes and modifications can be made without departing from the scope of the invention as defined by the following claims.

The invention claimed is:

1. Apparatus for making a packing material in the form of a string of air-filled packing cushions with rows of perforations extending across the material between ones of the chambers the cushions, comprising: means for feeding superposed layers of film material having longitudinally spaced, transversely extending rows of perforations along a path, means for injecting air between the two layers of film material, means for sealing the layers of film material together to form air-filled cushions between the rows of perforations, and means engagable with the string of air-filled cushions for partially tearing the material along the rows of perforations to facilitate tearing a desired number of the air-filled cushions from the string.

2. The apparatus of claim 1 wherein the means for partially tearing the material comprises a tear roller having an arcuate section which periodically engages an edge portion of the material and a section adjacent to the arcuate section which remains out of driving engagement the material.

3. The apparatus of claim 2 wherein the means for partially tearing the material also includes a feed roller with a surface in continuous driving engagement with the material for feeding the material at a predetermined speed.

4. The apparatus of claim 3 wherein the tear roller is larger in diameter than the feed roller.

5. The apparatus of claim 3 wherein the tear roller rotates faster than the feed roller.

6. A method of making a packing material in the form of a string of air-filled packing cushions with rows of perforations extending across the material between the cushions, comprising the steps of: feeding two superposed layers of film material having longitudinally spaced, transversely extending rows of perforations along a path, injecting air between the two layers of film material, sealing the layers of film material together to form air-filled cushions between the rows of perforations, and partially tearing the material along the rows of perforations by continuously engaging an edge portion of the material with a feed roller after the air-filled cushions are formed to feed the string of cushions at a predetermined speed and periodically exerting a abrupt pull on the material by engaging an edge portion of the material with a tear roller having an interrupted surface with an arcuate section which engages the material to exert the pull only during a portion of a rotation of the roller.

7. The method of claim 6 wherein the arcuate section travels faster than the predetermined speed.

8. Apparatus for making a string of air-filled packing cushions from an elongated strip of preconfigured film having a plurality of uninflated chambers formed between two layers of the film with rows of perforations extending across the film between successive ones of the chambers, comprising: means for injecting air between the layers to inflate the chambers, means for sealing the chambers to retain the air in them, means engagable with an edge portion of the film for feeding the film with the air-filled chambers along a path at a predetermined speed, and a tear roller having a surface that rotates faster than the predetermined speed and is intermittently engagable with the edge portion for exerting an abrupt periodic pull on the the edge which produces a partial tearing along the rows of perforations between the inflated chambers.

9. The apparatus of claim 8 wherein the surface of the tear roller has an arcuate section which periodically engages the edge portion of the material and a section adjacent to the arcuate section which remains out of driving engagement the material.

10. The apparatus of claim 8 wherein the means for feeding the film with the air-filled chambers at a predetermined speed comprises a feed roller with a surface in continuous driving engagement with the material.

11. The apparatus of claim 10 wherein the tear roller is larger in diameter than the feed roller.

12. The apparatus of claim 10 wherein the tear roller rotates faster than the feed roller.

13. A method of making a string of air-filled packing cushions from an elongated strip of preconfigured film having a plurality of uninflated chambers formed between two layers of the film with rows of perforations extending across the film between successive ones of the chambers, comprising the steps of: injecting air between the layers to inflate the chambers to form the cushions, sealing the chambers to retain the air in the cushions, feeding the material along a path at a predetermined speed, and intermittently engaging an edge portion of the material with a tear roller having a surface that travels faster than the predetermined speed for exerting an abrupt periodic pull on the material which produces a partial tearing along the rows of perforations between the inflated chambers.

14. Apparatus for pre-tearing a string of air-filled packing cushions having a plurality of longitudinally spaced air-filled chambers with rows of perforations extending across the material between successive ones of the chambers, comprising: means engagable with an edge portion of the material for feeding the string of cushions at a predetermined speed, and a continuously rotating tear roller having a surface that rotates faster than the predetermined speed and periodically engages the edge portion and exerts an abrupt pull on the material which produces a partial tearing along the rows of perforations between the cushions.

15. The apparatus of claim 14 wherein the surface of the tear roller has an arcuate section which periodically engages the edge portion of the material and a section adjacent to the arcuate section which remains out of driving engagement the material.

16. The apparatus of claim 14 wherein the means for feeding the material at a predetermined speed comprises a feed roller with a surface in continuous driving engagement with the material.

17. The apparatus of claim 16 wherein the tear roller is larger in diameter than the feed roller.

18. The apparatus of claim 16 wherein the tear roller rotates faster than the feed roller.

19. A method of pre-tearing a string of air-filled packing cushions having a plurality of longitudinally spaced air-filled chambers with rows of perforations extending across the material between successive ones of the chambers, comprising the steps of: engaging an edge portion of the material with a feed roller to feed the string of cushions at a predetermined speed in a direction generally perpendicular to the rows of perforations, and intermittently engaging the edge portion of the material with a continuously rotating tear roller having a surface that travels faster than the predetermined speed and periodically engages the material to exert an abrupt pull on the material to produce a partial tearing along the rows of perforations between the cushions.

* * * * *